US006402883B1

(12) United States Patent
Billett

(10) Patent No.: US 6,402,883 B1
(45) Date of Patent: Jun. 11, 2002

(54) POLISHING PAD CONDITIONING SURFACE HAVING INTEGRAL CONDITIONING POINTS

(75) Inventor: Bruce H. Billett, Gaston, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/473,452

(22) Filed: Dec. 28, 1999

Related U.S. Application Data

(63) Continuation of application No. 08/984,452, filed on Dec. 3, 1997, now Pat. No. 6,027,659.

(51) Int. Cl.[7] ..... H01L 21/302; B24B 1/00

(52) U.S. Cl. ..... 156/345; 216/11; 216/88; 216/38; 216/90; 427/590; 432/690; 432/691; 432/692; 457/285

(58) Field of Search ..... 156/345; 216/11, 216/88–90, 38; 427/590; 451/72, 285–289; 438/690–693

(56) References Cited

U.S. PATENT DOCUMENTS

| | | | | |
|---|---|---|---|---|
| 5,186,973 A | * | 2/1993 | Garg et al. | 427/590 |
| 5,216,843 A | | 6/1993 | Breivogel et al. | |
| 5,527,424 A | * | 6/1996 | Mullins | 438/692 |
| 5,536,202 A | * | 7/1996 | Appel et al. | 451/285 |
| 5,547,417 A | | 8/1996 | Breivogel et al. | |
| 5,611,943 A | | 3/1997 | Cadien et al. | |
| 5,626,509 A | * | 5/1997 | Hayashi | 451/285 |
| 5,783,488 A | | 7/1998 | Bothra et al. | |
| 6,027,659 A | * | 2/2000 | Billett | 216/11 |

* cited by examiner

*Primary Examiner*—Robert Kunemund
(74) *Attorney, Agent, or Firm*—Cynthia T. Faatz

(57) ABSTRACT

A pad conditioner having integral conditioning points. The pad conditioner includes a conditioning surface having a first integral conditioning point extending from the conditioning surface. For one embodiment the conditioning surface is formed of diamond and an array of integral conditioning points including the first integral conditioning point extends from the diamond surface.

14 Claims, 6 Drawing Sheets

POLISHING PAD CONDITIONING SURFACE HAVING INTEGRAL CONDITIONING POINTS

This application is a continuation of U.S. Patent Application 08/984,452 filed Dec. 3, 1997 entitled "A POLISHING PAD CONDITIONING SURGACE HAVING INTEGRAL ONDITIONING POINTS," now U.S. Pat. No. 6,027,659 to Billett and assigned to the assignee of the present invention.

BACKGROUND OF THE INVENTION

1. Field of the Invention

The present invention relates to the field of semiconductor manufacturing, and more particularly to the field of conditioning of polishing pads used for chemical-mechanical and other types of polishing.

2. Discussion of Related Art

In semiconductor manufacturing, chemical-mechanical polishing (CMP) is often used to ensure planar topography in the fabrication of integrated circuits and other semiconductor devices.

For one approach, a silicon or other semiconductor wafer is placed face down on a table covered with a flat pad that has been coated with slurry, an abrasive material. Both the wafer and that table are then rotated relative to each other to remove steps and other protrusions in the topography of the wafer. This abrasive polishing process continues until the surface of the wafer contacting the pad is largely planar.

One factor in achieving and maintaining a high and stable polishing rate is conditioning of the flat pad to maintain pad roughness. Over time, the initially rough and/or grooved surface of the flat pad is worn down due to polishing. Further, during polishing, the polishing pad has a tendency to glaze over due to build-up on the pad surface of slurry and other deposits.

A smooth pad surface results in a reduction of slurry delivery to the wafer surface causing low, unpredictable polish rates. Low polish rates decrease wafer throughput and make the planarization process difficult to control. Further, when the pad surface becomes "glazed" or smoothed through use, rough wafers are polished at a different, higher rate than smooth wafers.

To prevent glazing, the polishing pad is mechanically scored or "conditioned." Conditioning the pad removes the slurry/deposit build-up and roughens the surface of the pad. Different approaches to conditioning may be required depending on the hardness of the pad surface and the particular slurry used for polishing. Further, conditioning may be performed by a conditioning apparatus in a discrete conditioning step or during wafer polishing depending on the specific conditioning process and apparatus used.

An example of a conditioning apparatus 100 used for a discrete conditioning step is shown in FIG. 1. The apparatus 100 includes a conditioning block or bar 105 that is rotated concentrically about the axis 110 to condition the pad 120 when the conditioning block 105 is pressed against the pad 120. U.S. Pat. No. 5,611,943 to Cadien et al. and assigned to Intel Corporation, the assignee of the present invention, also describes an approach for conditioning pads between wafer polishing steps.

Diamond is a preferred pad conditioning surface material because of its durability, even in processes using very abrasive slurries. Pad conditioning surface materials that wear more easily than diamond may require frequent replacement and/or servicing of the scoring apparatus or pad conditioning block.

FIG. 2 shows a cross-section of one prior conditioning block 200, also referred to more generally as a scoring apparatus, that may be used with a conditioning apparatus such as the conditioning apparatus 100 of FIG. 1. The conditioning block 200 includes a block base 205 made of stainless steel having embedded stainless steel threaded shanks 210 and a wear plate 212 to prevent excessive wear to the conditioning block. The shanks 210 have diamond tips 215 braised or otherwise mounted on the threaded shanks 210. The shanks 210 are adjustable to control the extent to which the diamond tips 215 protrude from the block base 205 and the wear plate 212. A conditioning block including threaded shanks is described in U.S. Pat. No. 5,216,843 to Breivogel et al. and assigned to Intel Corporation, the assignee of the present invention.

The above-described approach, while effective in providing pad conditioning for pads having hard pad surfaces, has some drawbacks with respect to efficiency and cost. The threaded shanks 210 having the diamond tips 215 may require frequent adjustment with special tools by trained personnel. The adjustments themselves are subjective, and thus, may vary from person to person. Further, the diamond tips 215 must be flawless such that they do not easily chip during the polishing process. Consequently, this approach may be costly in terms of material and implementation.

FIG. 3 shows a cross-section of another prior approach for a conditioning block. The conditioning block 300 of FIG. 3 uses a diamond impregnated material or diamond grit 305 for pad conditioning. The conditioning block 300 of FIG. 3 may be used with the pad conditioning apparatus of FIG. 1 or another pad conditioning apparatus.

For this approach, there is a disadvantage in that the diamond grit 305 used to provide a pad conditioning surface easily separates from the pad conditioning block 300 as the adhesive 310 used to hold the diamond grit 305 in place wears. The loose diamond grit can cause scratching of the wafer and even contamination of other semiconductor materials in the vicinity of the pad conditioner because the diamond grit 305 is not made for use in a cleanroom environment.

SUMMARY OF THE INVENTION

A polishing pad conditioner having integral points is described. An apparatus for conditioning a pad includes a conditioning surface having a first integral conditioning point extending from the conditioning surface.

For one embodiment, the first integral conditioning point is one point in an array of integral conditioning points on the conditioning surface.

Other features and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings in which like references indicate similar elements, and in which.

DETAILED DESCRIPTION

A pad conditioning block having integral points is described. Although the following embodiments refer to pad conditioners for pads used in chemical-mechanical polishing, pads used for other polishing purposes, where maintaining the roughness of the polishing pad is important, may also benefit from the present invention.

An intended advantage of one or more embodiments is to provide a pad conditioning surface that has a high durability, does not require frequent adjustment, and does not present a high risk of contamination of other semiconductor materials. Further advantages of one or more embodiments described below include a relatively low cost of manufacturing and maintenance.

An apparatus for conditioning of a polishing pad includes a conditioning surface having at least a first integral conditioning point. For some embodiments, the conditioning surface is formed of diamond and an array of integral diamond conditioning points are formed in the diamond surface. Also for some embodiments, a substrate is provided and a layer including the conditioning surface is disposed on the substrate. The substrate may be stainless steel, carbide or another material having a thermal coefficient of expansion that is similar to that of the material forming the conditioning surface. Other features and advantages of various embodiments are described in more detail below with reference to the Figures.

Figure 4:
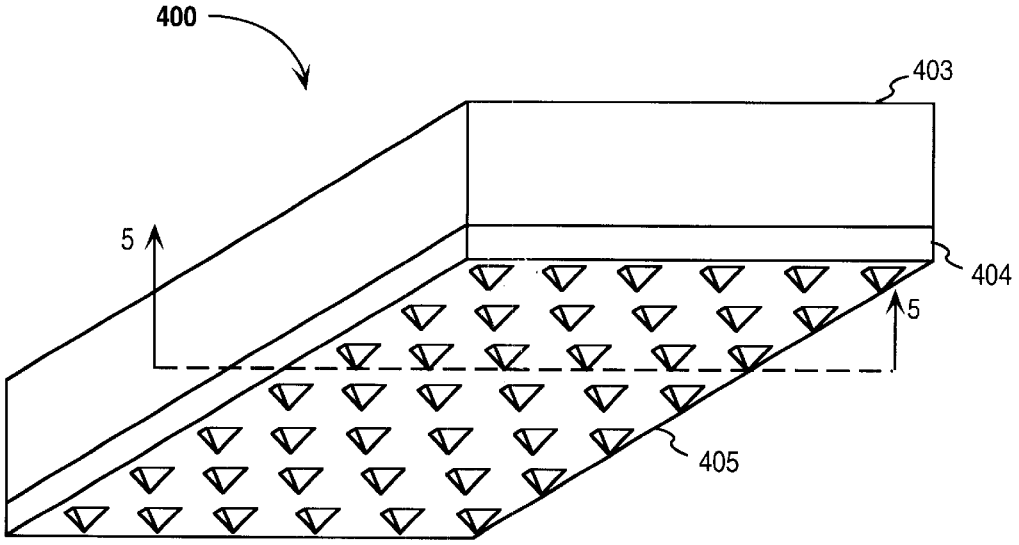
FIG. 4 shows a perspective view of the conditioning block of one embodiment including integral points.

FIG. 4 shows a perspective view of the pad conditioning block 400 of one embodiment, also referred to herein as a scoring apparatus. The pad conditioning block 400 includes a substrate 403 and a layer 404 including a conditioning surface 405. Integral conditioning points 410 extend from the conditioning surface 405. The surface 405 is referred to as a conditioning surface as it is the surface that contacts a pad to be conditioned during the conditioning process.

The layer 404 and included surface 405 are formed of diamond for the embodiments described with reference FIGS. 4–6. The diamond layer 404 and surface 405 may be synthetic or naturally formed diamond. Other materials, such as sapphire, that have a hardness greater than the slurry or other polishing material used with the pad to be conditioned, may also be used to form the layer 404 and included surface 405 for other embodiments.

For one embodiment, the diamond layer 404 is formed by a deposition process such as a carbon chemical vapor deposition process, and the integral points 410 are formed by selectively etching the diamond layer 404 to form the points. Where the diamond layer 404 is formed in this manner, the diamond material is deposited carbon and is referred to herein as diamond or polycrystalline diamond.

For another embodiment, another type of carbon deposition process such as a laser deposition process is used. The laser deposition process used for one embodiment is a process that allows targeted or selective deposition. This process can be targeted to only deposit material in one or more selected regions. Thus, where the layer 404 is diamond, the laser deposition process can used to deposit carbon to form a polycrystalline diamond layer. Then following deposition of the diamond layer 404, the integral points 410 can be selectively, locally deposited and integrally formed with the diamond layer 404 by targeting the laser deposition process using the same deposition materials. In this manner, an etch process is not required to integrally form the conditioning points 410. Other methods and materials for forming the layer 404 may also be used for other embodiments.

The substrate 407 is formed of stainless steel for one embodiment, but may be formed of other materials, such as carbide, that have a thermal coefficient of expansion similar to that of the diamond layer 404. Stainless steel is selected for one embodiment because of its low cost, relative hardness, and the similarity between the thermal coefficients of expansion of stainless steel and diamond. Carbide is selected for another embodiment because its expansion characteristics are very similar to those of diamond and thus, chances of the diamond layer 404 shearing off of and separating from the substrate 407 are relatively low. Carbide, however is more costly than stainless steel and therefore, may not be preferred for price-sensitive applications.

For embodiments in which other materials are used to form the layer 404, the substrate material is chosen to have a similar thermal coefficient of expansion to that of the material forming the layer 404.

With continuing reference to FIG. 4, the array of integral conditioning points 410 extending from the diamond conditioning surface 405 acts to roughen and/or score the pad surface during a conditioning process to provide the required pad conditioning. The array of integral points 410 may include any number of points that may be provided in any arrangement.

For example, for one conditioning process, the larger the number of points in the array of integral points 410, the more efficient and thorough the pad conditioning process is likely to be. In contrast, more points in the array may mean that the inspection process will take longer, especially if a manual inspection process is used. Thus, for one embodiment, the number of integral points is selected to strike a balance between these competing interests. For the conditioning block having the above described dimensions, for example, the array of points 410 may include six rows of 17 points each. Where the conditioning block can be quickly inspected by a mechanical means, the array of integral points may be very dense.

The conditioning block 400 of one embodiment is approximately 1" thick, however it may be any size. In particular, the dimensions of the conditioning block may be chosen based on the size of the pad to be conditioned, the conditioning apparatus to be used with the conditioning block and/or desired patterns of use, maintenance and replacement. The thickness of the diamond layer 404 is about 20 microns for one embodiment, but may be a different thickness for other embodiments. The thickness of the diamond layer 404 and the substrate 403 may also be selected for the particular conditioning equipment to be used and/or the process used to form the conditioning block 400.

Further, for other embodiments, the substrate may be formed in a particular shape that provides for the conditioning block to be easily adapted and/or connected to a conditioning apparatus with which the conditioning block is to be used. For example, the substrate may include integrally formed flanges, rails, or other means for coupling and/or securing the conditioning block to a conditioning apparatus. For such embodiments, the portion of the substrate immediately above the diamond layer should maintain a thickness sufficient for the substrate material used to prevent flexing of the conditioning block and the diamond layer.

Figure 5:
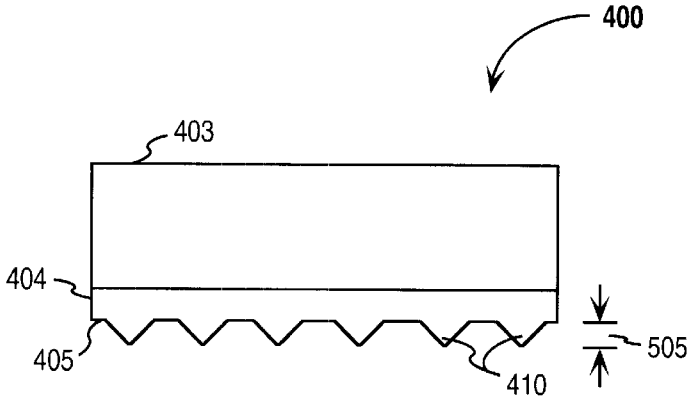
FIG. 5 shows a cross-section of the conditioning block of FIG. 4 taken at the line 5—5.

FIG. 5 shows a cross-sectional view of the conditioning block 400 of FIG. 4 taken along the line 5—5 that traverses the peak of a row of the integral conditioning points 410. As shown in FIG. 5, the array of conditioning points 410 are integrally formed in the diamond surface 405. "Integrally formed" or "integral points" refers to the fact that the points 410 are formed of the same material as, and are integral to the conditioning surface 405. That is to say that the points 410 are not separately attached to the conditioning surface 405, but rather they extend from (not through) the conditioning surface 405. Because the conditioning points 410 are integrally formed with the conditioning surface 405, they are not easily detached from the conditioning surface 405 during polishing.

For one embodiment, each of the points in the array of integral points 410 of the pad conditioning block 400 is a 90 degree included point, i.e. the angle formed at each point is ninety degrees. The conditioning points 410 for this embodiment are selected to be ninety degree points such that they are strong to prevent damage to the points, while still providing enough of a point to easily score or roughen the surface of a polishing pad. Further, for one embodiment, each of the conditioning points has a square base where the conditioning surface extends to form the point and the point has a pyramid-like shape as shown in FIG. 4. The integral points of other embodiments may be formed to a different angle and different shape.

The integral conditioning points 410 for one embodiment are formed such that each of the points in the array of integral points 410 extends substantially the same distance 505 from the conditioning surface 405 as the other points in the array. For other embodiments, the points may be formed to extend over a variety of different distances from the surface 405 for particular pad conditioning processes.

Figure 6:
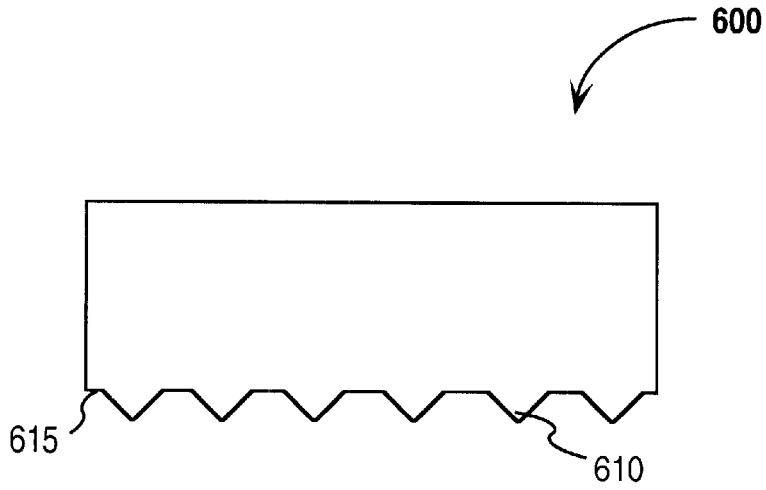
FIG. 6 shows a cross-section of a conditioning block of another embodiment.

FIG. 6 shows a cross-section of a pad conditioning block or scoring apparatus 600 of another embodiment. The pad conditioning block 600 is formed entirely or primarily of diamond or another material having a sufficient hardness to withstand the polishing material used with the pad to be conditioned. Thus, the conditioning block 600 does not include a separate substrate of another material. Similar to the conditioning block 400 of FIGS. 4 and 5, the conditioning block 600 includes integral conditioning points 610 that extend from a conditioning surface 615.

Where the conditioning block 600, conditioning surface 615 and integral conditioning points are formed of diamond, the conditioning block 600 may be formed of synthetic or natural diamond. Where the conditioning block 600 is formed of synthetic diamond, the conditioning block 600 may be formed in a manner similar to the diamond layer 405 of the conditioning block 400 of FIGS. 4 and 5. Also similar to the conditioning block 400 of FIGS. 4 and 5, the integral conditioning points 610 are ninety degree points arranged in rows for one embodiment. For other embodiments, however, the points may be any angle in any arrangement.

Figure 1:
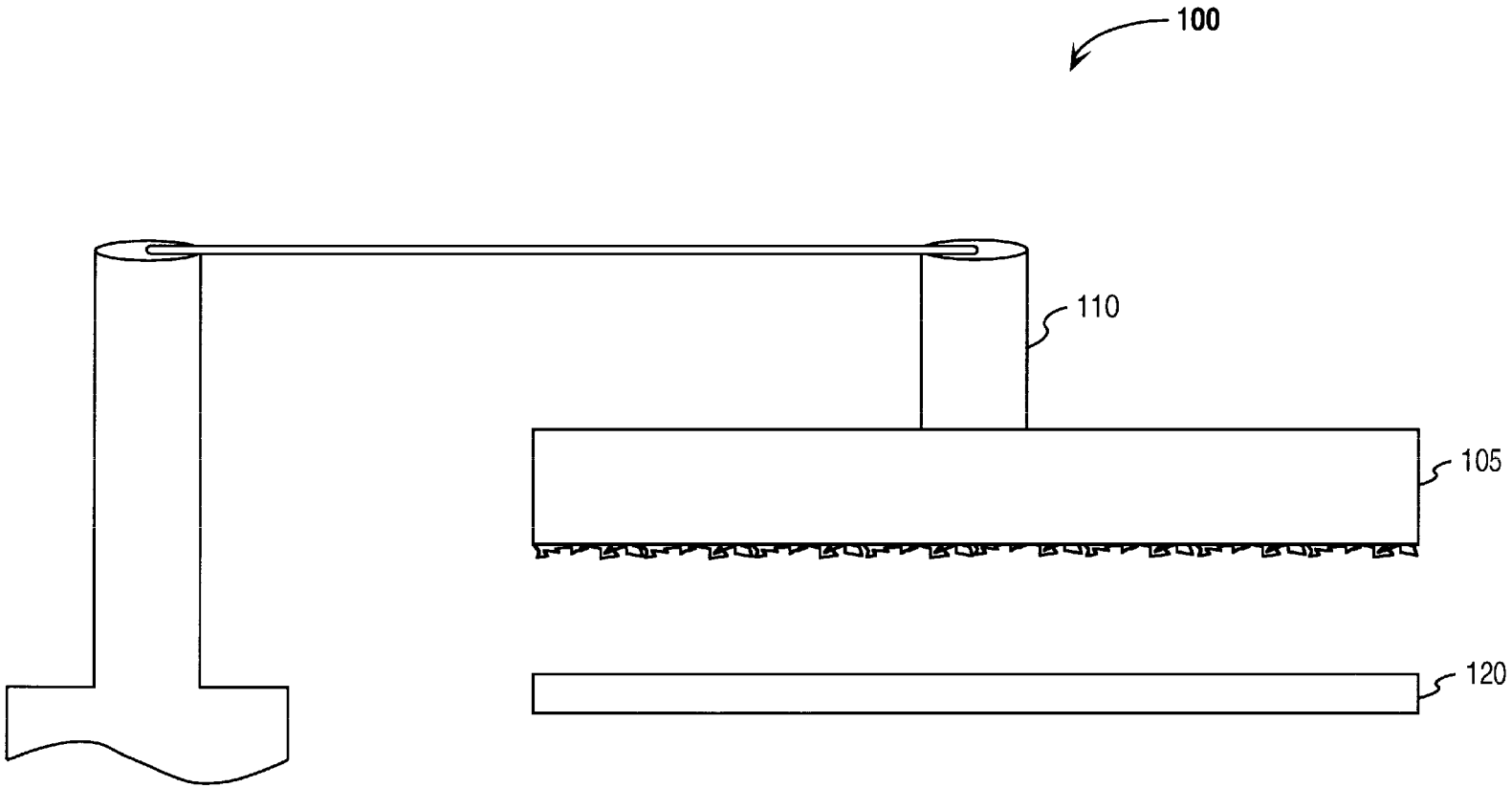
FIG. 1 shows a prior pad conditioning approach.
Figure 2:
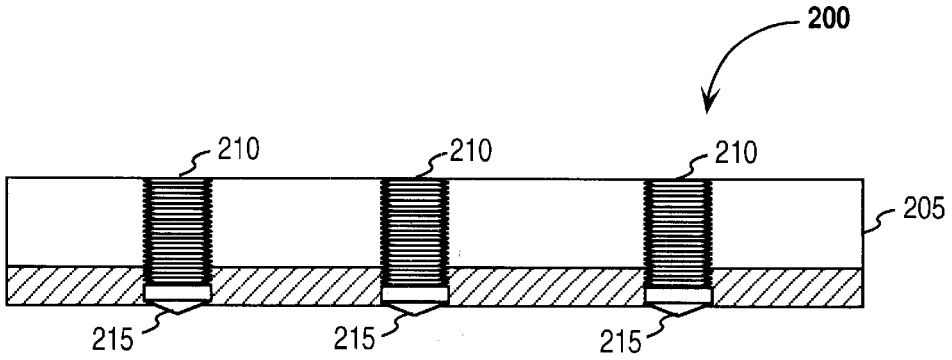
FIG. 2 shows a prior stainless steel conditioning block having threaded shanks with diamond tips.
Figure 3:
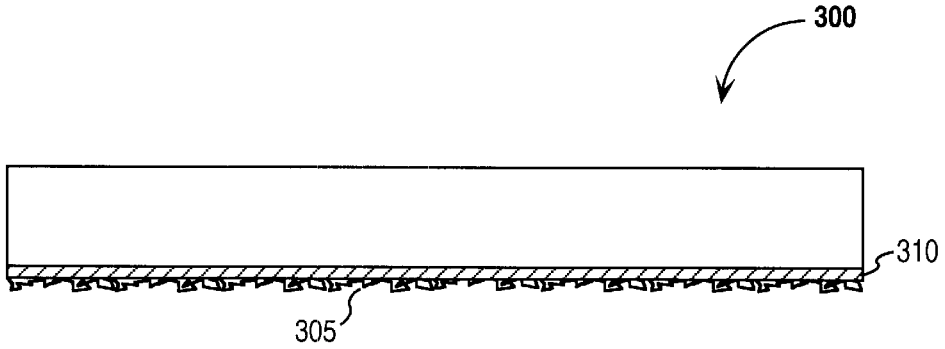
FIG. 3 shows another prior pad conditioning block that uses a diamond impregnated material for pad conditioning.
Figure 7:
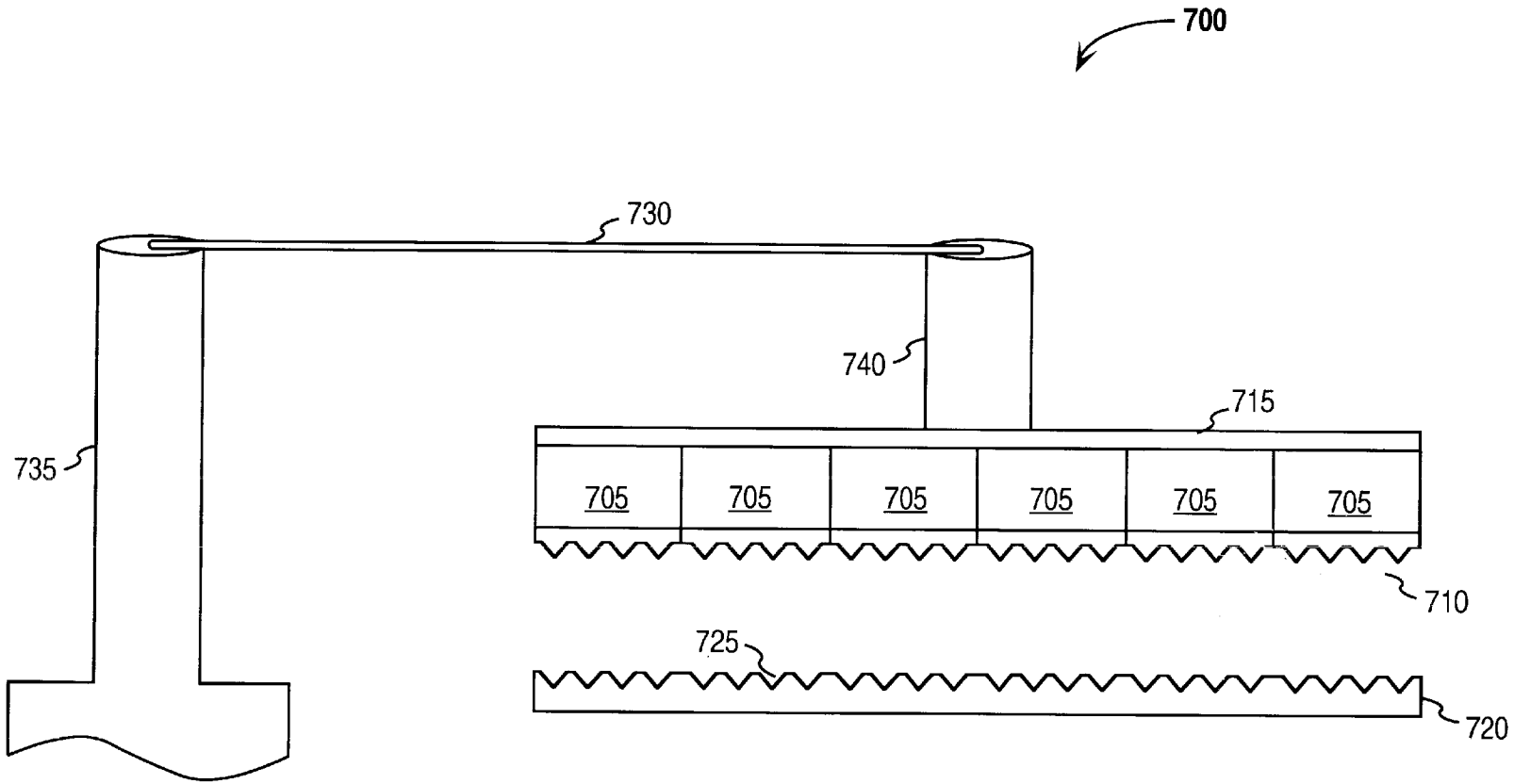
FIG. 7 shows a pad conditioning apparatus that may use one or more of the conditioning blocks of FIGS. 4 and 6.

FIG. 7 shows a pad conditioning apparatus 700 that may be used with one or more of the conditioning blocks described with reference to FIGS. 4–6. The pad conditioning apparatus 700 of FIG. 7 operates in a similar manner to the prior pad conditioning apparatus described with reference to FIG. 1.

The pad conditioning apparatus 700 operates to condition the pad 720 between chemical-mechanical polishing processes. More specifically, after a predetermined number of wafers have been polished by a chemical-mechanical polisher (not shown) or after the wafer polishing rate has decreased below a desired level, the pad 720 is conditioned.

A pivot arm 730 of the pad conditioning apparatus 700 is pivoted about an axis 735 from a park position away from the pad 720 until an end of the pivot arm 730 is directly over the center of the pad 720. It will be appreciated that although a diametric arm is described, a radial arm may also be used.

A conditioning block mount 715 is coupled to the end of the pivot arm 730 that overlies the pad 720. The conditioning block mount 715 is rotatable about its center and is coupled to one end of the pivot arm 730 by a rotation axis 740. The rotation axis 740 is centered on the conditioning block mount 715 and directly overlies the center of the pad 720. Because the rotation axis 740 and the center of the pad 720 lie along the same vertical line, the conditioning block mount 715 rotates about its center in a concentric motion over the pad 720 to concentrically and uniformly polish the pad 720.

The pad conditioning apparatus 700 of FIG. 7, includes a different pad conditioning surface 710 than that used for prior pad conditioners. The conditioning surface 710 is formed of multiple pad conditioning blocks 705. Each of the pad conditioning blocks 705 of the embodiment shown in FIG. 7 is similar to the pad conditioning block 400 described with reference to FIGS. 4 and 5. For other embodiments, the pad conditioning blocks may be similar to the pad conditioning block 600 of FIG. 6 or to pad conditioning blocks of other embodiments. Also, although six pad conditioning blocks 705 are shown in FIG. 7, a different number of pad conditioning blocks or a single pad conditioning block may be used for other embodiments.

For one embodiment, the pad conditioning blocks 705 are mounted to the conditioning block mount 715 of the pad conditioning apparatus 700. The conditioning blocks 705 may be mounted using special mounting features (not shown) formed in the substrates of the conditioning blocks 705 or in another manner. Multiple pad conditioning blocks 705 may be provided such that the pad conditioning apparatus 700 can be easily maintained. More specifically, if one of the conditioning blocks 705 is damaged or worn, only one conditioning block of six needs to be replaced. This can help to reduce the cost of the pad conditioning process by limiting the number of diamond pad conditioning blocks that need to be replaced at any one time. Also, if the conditioning process wears the conditioning blocks 705 unevenly, they can be rotated to different positions on the conditioning block mount 715 of the conditioning apparatus 700.

In operation, the pad 720 is pressed against the conditioning surface 710, for one embodiment. For another embodiment, the height of the conditioning surface 710 above the pad 720 can be adjusted to press the conditioning surface 710 against the pad 720. The conditioning block mount 715 holds the conditioning blocks 705 against the surface of the pad 720 and rotates the conditioning blocks 705 about the axis 740 such that the pad 720 surface is roughened and/or small grooves 725 are formed in the pad surface 720. The conditioning rate, height of the conditioning surface 710 above the pad 720, and other features may be selectable depending on the material being polished and/or the degree of polishing desired. It will be appreciated that other pad conditioning approaches using a different pad conditioning apparatus and method may also benefit from the embodiments described above.

Figure 8:
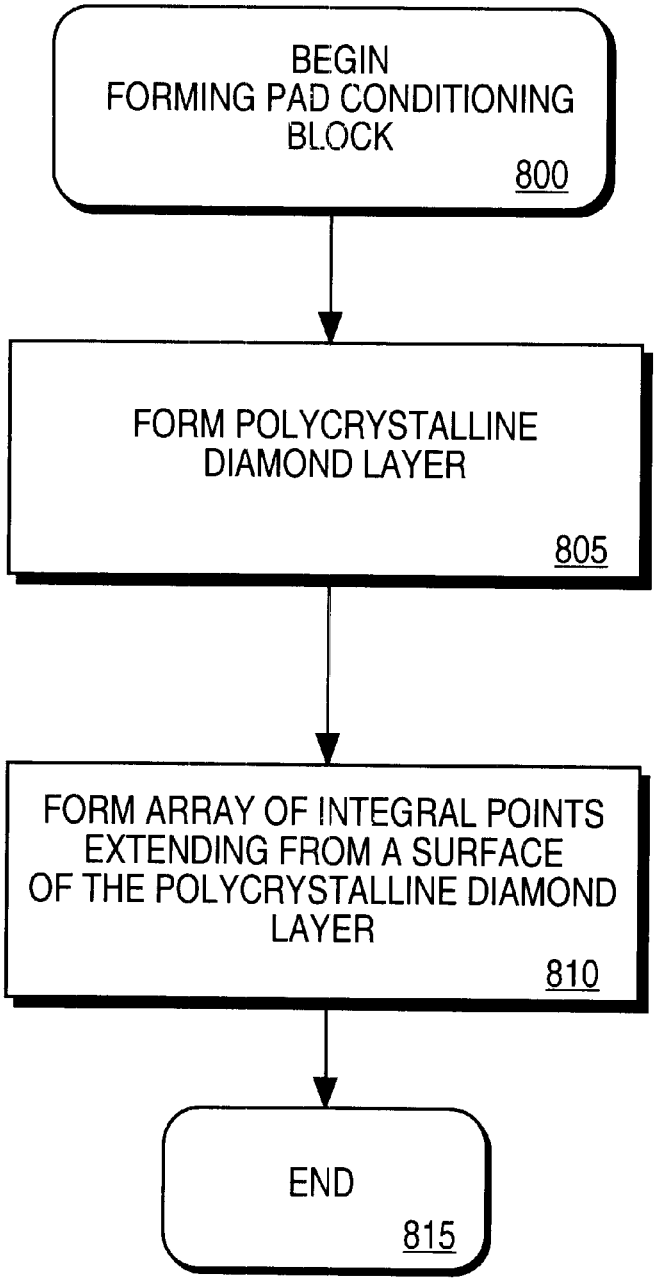
FIG. 8 is a flow diagram showing one embodiment of the method for forming a pad conditioning block.

Referring to FIG. 8, one embodiment of the method for forming a conditioning block or scoring apparatus is described beginning at step 800. In step 805, a layer including a conditioning surface is formed.

For one embodiment, this layer is a synthetic, polycrystalline diamond layer formed on a substrate comprising a material other than diamond. For another embodiment, a polycrystalline diamond layer is formed such that it can be used as a conditioning surface without requiring a substrate of a different material. For other embodiments, a single crystal diamond or a different material having a hardness greater than that of the wafer polishing material used with the pad to be conditioned is used to form the layer.

Also, for one embodiment, the polycrystalline diamond layer is formed using a conventional chemical vapor deposition (CVD) process. For another embodiment, the polycrystalline diamond layer is formed using another type of deposition process that allows the polycrystalline diamond layer formation to be selectively formed as described below with respect to the integrally formed points.

In step 810, an array of conditioning points is integrally formed with the layer formed in step 805 to extend from the conditioning surface. For embodiments in which the layer is a polycrystalline diamond layer formed using a conventional CVD process, the array of integral conditioning points is formed by etching the polycrystalline diamond layer to create the points.

For embodiments in which the layer is a polycrystalline diamond layer formed using a deposition process that allows targeted or selective formation of structures, the array of integral conditioning points is formed using the targeted deposition process without requiring an etch step.

Thus, a pad conditioning block or scoring apparatus having integral conditioning points and method for forming the same are described. The pad conditioning block or scoring apparatus of the embodiments described above provides the advantage of a durable pad conditioning surface that does not require adjustment of conditioning points. Further, the pad conditioning block of the above-described embodiments does not use diamond grit or adhesives that can easily be dislodged from the pad conditioning surface. Compared to pad conditioners that use such materials, the pad conditioning block of the above-described embodiments reduces the risk of contamination that may be caused by the pad conditioning process.

Although the above-described embodiments refer to substantially rectangular conditioning blocks have planar diamond conditioning surfaces, it will be appreciated by those skilled in the art that a non-rectangular scoring apparatus and/or a scoring apparatus having a non-planar conditioning surface formed of a hard material other than diamond may also be formed in accordance with other embodiments. Further, although, specific processes for forming the conditioning block or scoring apparatus of various embodiments have been described, other processes for forming a hard conditioning surface having integral conditioning points are also within the scope of the invention.

In the foregoing specification, the invention has been described with reference to specific exemplary embodiments thereof. It will, however, be appreciated that various modifications and changes may be made thereto without departing from the broader spirit and scope of the invention as set forth in the appended claims. The specification and drawings are, accordingly, to be regarded in an illustrative rather than a restrictive sense.

What is claimed is:

1. An apparatus for conditioning a pad comprising:

a conditioning block having a diamond deposition conditioning layer including a first integral conditioning point extending from a conditioning surface on the diamond deposition conditioning layer, the integral conditioning point comprising diamond throughout the entirety of its cross-section.

2. The apparatus of claim 1 wherein the conditioning block further includes a substrate wherein the diamond deposition conditioning layer including the conditioning surface is disposed on the substrate.

3. The apparatus of claim 2 wherein the substrate is one of stainless steel or carbide.

4. The apparatus of claim 1 wherein the conditioning layer has an array of integral conditioning points extending from the conditioning surface, the array including the first integral conditioning point, each one of the array of integral conditioning points entirely comprising diamond.

5. The apparatus of claim 1 wherein the conditioning block is to be coupled to a controllable pad conditioning block mount.

6. The apparatus of claim 2 wherein the substrate is to be coupled to a controllable pad conditioning block mount.

7. A pad conditioning apparatus comprising:

a conditioning block having a diamond deposition conditioning layer including an array of integral conditioning points extending from a first surface of the diamond deposition layer, each of the array of integral conditioning points comprising diamond throughout its cross-section.

8. The pad conditioning apparatus of claim 7 wherein the layer is a diamond layer.

9. The pad conditioning apparatus of claim 7 wherein a second surface of the layer is coupled to a substrate of the pad conditioning block.

10. The pad conditioning apparatus of claim 7 wherein the conditioning block further includes a substrate to be coupled to a pad conditioning block mount, the layer including the array of integral conditioning points being disposed on the substrate.

11. The pad conditioning apparatus of claim 8 wherein the conditioning block further includes a substrate formed of one of stainless steel or carbide, the substrate to be coupled to a pad conditioning block mount, the layer including the array of integral conditioning points being disposed on the substrate.

12. A method for forming a pad scoring apparatus comprising:

depositing a diamond conditioning layer including a conditioning surface using a chemical vapor deposition process, the conditioning surface to be coupled to a conditioning block; and integrally forming an array of conditioning points extending from the conditioning surface of the layer, each of the conditioning points comprising diamond throughout its cross-section.

13. The method as set forth in claim 12 wherein forming the layer is performed using a carbon chemical vapor deposition process to form the diamond deposition layer, and integrally forming an array of conditioning points is performed by etching the layer.

14. The method as set forth in claim 12 wherein forming the layer is performed using a carbon deposition process to form the diamond deposition layer, and integrally forming an array of conditioning points is performed using a argeted deposition process, the targeted deposition process integrally forming the array of conditioning points on the conditioning surface.

* * * * *

UNITED STATES PATENT AND TRADEMARK OFFICE

CERTIFICATE OF CORRECTION

PATENT NO. : 6,402,883 B1
DATED : June 11, 2002
INVENTOR(S) : Billett

It is certified that error appears in the above-identified patent and that said Letters Patent is hereby corrected as shown below:

Column 8,
Line 63, delete “a argeted” and insert -- a targeted --.

Signed and Sealed this

Seventeenth Day of December, 2002

JAMES E. ROGAN
*Director of the United States Patent and Trademark Office*